United States Patent [19]

Fielding

[11] Patent Number: 4,871,122

[45] Date of Patent: Oct. 3, 1989

[54] ROLL DISPENSER UNIT

[76] Inventor: Robert M. G. Fielding, 65 Clarendon Rd., Lythan-St. Annes, Lancashire, England, FY8 3HX

[21] Appl. No.: 128,627

[22] Filed: Dec. 4, 1987

[30] Foreign Application Priority Data

Dec. 5, 1986 [GB] United Kingdom ..... 8629139

[51] Int. Cl.[4] ..... B65H 19/00

[52] U.S. Cl. ..... 242/55.2; 242/55.53

[58] Field of Search ..... 242/55.2, 55.53

[56] References Cited

U.S. PATENT DOCUMENTS

| | | | |
|---|---|---|---|
| 2,441,740 | 5/1948 | Worley | 242/55.2 |
| 2,486,678 | 11/1949 | Rashko | 242/55.2 |
| 2,513,699 | 7/1950 | Williams | 242/55.2 |
| 2,673,693 | 3/1954 | Gray | 242/55.2 |
| 2,701,110 | 2/1985 | Guyer | 242/55.2 |
| 2,959,368 | 11/1960 | Neff | 242/55.2 |
| 3,061,217 | 4/1962 | Grant | 242/55.2 |
| 4,099,681 | 3/1978 | House | 242/55.2 |
| 4,149,680 | 4/1979 | Whatley | 242/55.2 |
| 4,304,367 | 12/1981 | Beere | 242/55.2 |

FOREIGN PATENT DOCUMENTS 496489 6/1937 United Kingdom .

*Primary Examiner*—David Werner

*Attorney, Agent, or Firm*—Majestics, Parsons, Siebert & Hsue

[57] ABSTRACT

A support bracket for mounting a roll in a roll dispensing unit, comprises perpendicular arms, the edges of the arms for mounting the roll being curved to provide a desired degree of frictional resistance to rotation of the roll thereon. The curved edges may alternatively be provided by a rectangular plate secured to arm. The arms have integral portions to secure a cylindrical cover around the roll to be dispensed.

3 Claims, 2 Drawing Sheets

ROLL DISPENSER UNIT

BACKGROUND OF THE INVENTION

The present invention relates to a roll dispenser unit with a support bracket and more particularly a substantially L-shaped bracket for supporting a paper roll, e.g. in a washroom.

In one known dispenser unit for a paper towel roll, a mild steel support tube is welded to a wall mounting plate. This is a relatively expensive assembly method. Furthermore the dispenser has the disadvantage that the paper towel roll can be pulled out so quickly that the entire roll is dispensed at once.

To overcome this second disadvantage a braking collar can be provided as a separate component, thus necessitating extra expense. In addition, further means need to be provided for attachment of a cover for the unit.

In another dispenser, a paper towel roll is supported by a wire loop, but here again a large number of components and hence several assembly steps required.

SUMMARY OF THE INVENTION

The present invention seeks to overcome or reduce at least one of the above disadvantages.

According to a first aspect of the present invention there is provided a roll dispenser unit comprising a support bracket with first and second arms of substantially flat material and arranged substantially at right-angles to each other and having longitudinal edges, said edges of a first of said arms being curved over at least part of their length, and said arms each having a free end, one or both of said free end being provided with integral attachment means, the unit further comprising a generally cylindrical cover disposed on said bracket, with portions of said cover being engaged by said integral attachment means.

According to a second aspect of the present invention there is provided a roll dispenser unit comprising a support bracket with first and second arms of substantially flat material and arranged substantially at right angles to each other and having longitudinal edges, a parallel plate member secured to a first of said arms, said plate member having longitudinal edges substantially parallel to the longitudinal edges of said plate member being curved over at least part of their length, said arms of said bracket each having a free end, said free ends being provided with integral attachment means, and a generally cylindrical cover disposed on said bracket, with portios of said cover being engaged by said integral attachment means.

BRIEF DESCRIPTION OF THE DRAWINGS

A preferred embodiment of the present invention will now be described, by way of example only, with reference to the accompanying drawings, of which.

DESCRIPTION OF THE PREFERRED EMBODIMENT

Figure 1:
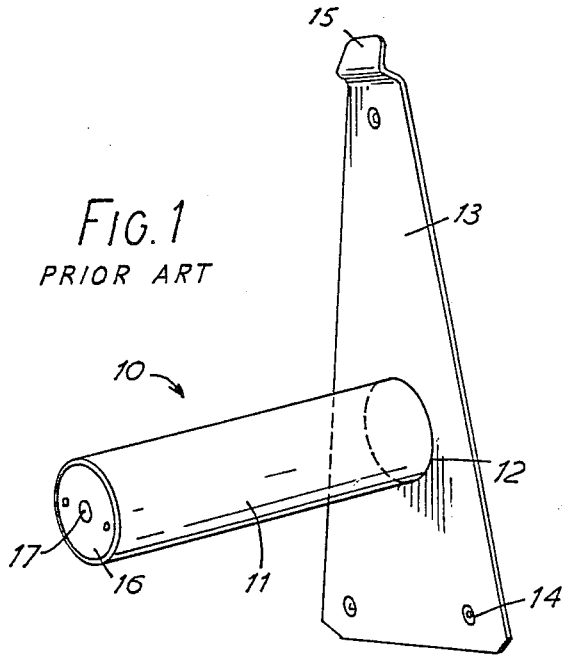
FIG. 1 PRIOR ART
FIG. 1 is a perspective view of a known support for a paper towel roll.
Figure 2:
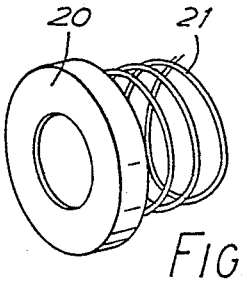
FIG. 2 PRIOR ART
FIG. 2 shows a braking collar for use with the support of FIG. 1.

In FIG. 1, a known support 10 for a paper towel roll dispenser comprises a mild steel tube 11 which may have a wall thickness of 1 mm and a diameter of 38 mm. At one end 12, the tube 11 is welded to a wall mounting plate 13 which has screw holes 14 for securing it to the wall. At the top, plate 13 is provided with a tab 15.

A circular plate 16 of mild steel is welded to the other end of tube 11, the plate having a central aperture 17. The cover (not shown) of the dispenser comprises a generally cylindrical member having an open end and a closed end. When a paper roll towel has been mounted on tube 11, the open end of the cover is presented to the support 10. The centre of the closed end is positioned directly adjacent to the aperture 17, to which it is secured by a locking arrangement (not shown). At the same time the tab 15 engages the periphery of the open end of the cover to prevent rotation thereof. In use the paper is withdrawn through a slot extending along the side of the cover.

A problem with the above described dispenser is excess rotation of the paper towel roll when dispensing. To impose a braking effect on the roll, a braking collar 20 may be loosely provided around end 12 of tube 11. To the inside of the rear of the collar there is welded a coil spring 21. When the paper roll is positioned on tibe 11, the circular rear face of the roll engages the collar 20 and compresses spring 21. The compression applies a frictional braking load between the inside of the cover and the circular front face of the roll.

A disadvantage of the above described dispenser is that the support comprises a relatively large number of components which need to be assembled together. Although a braking effect can be provided, this requires yet another component, and there is the additional disadvantage that the braking collar can be damaged or lost during reloading of the dispenser with a paper towel roll.

Figure 3:
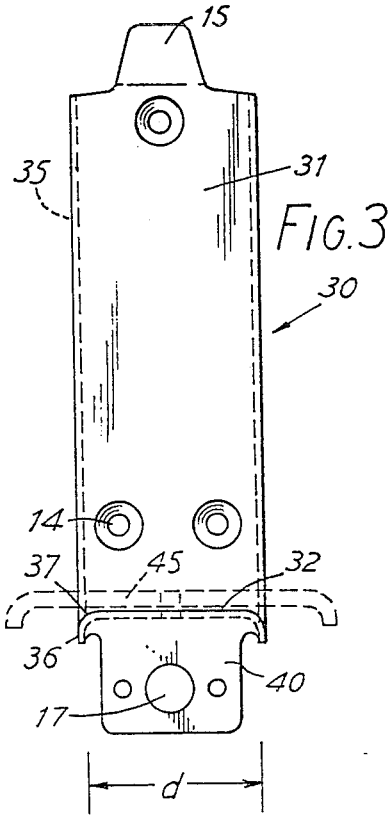
FIG. 3 is a front view of a support bracket in accordance with the present invention.
Figure 4:
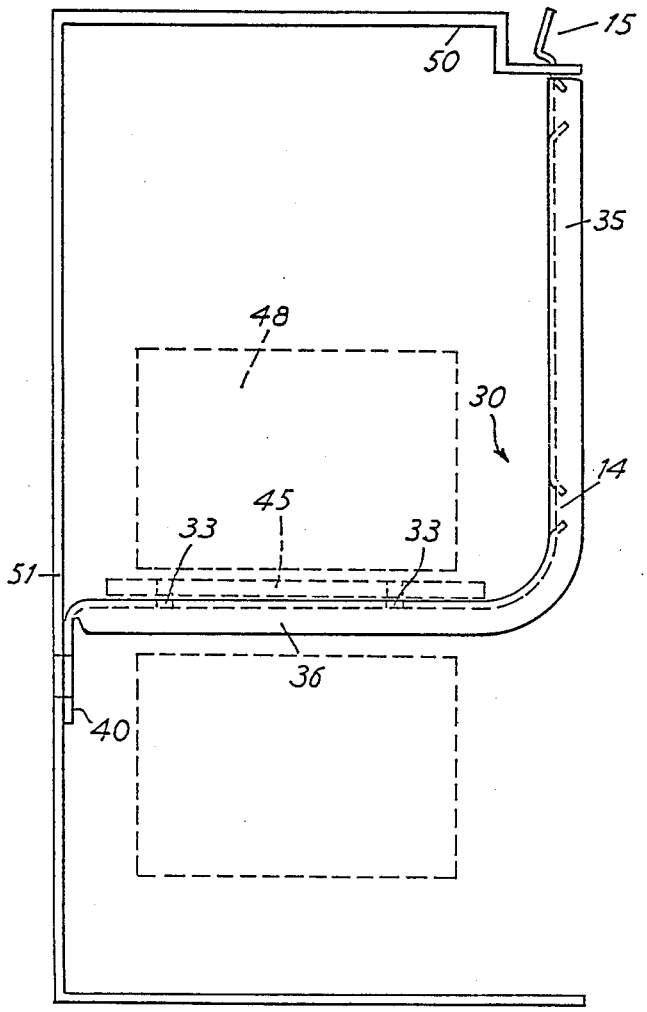
FIG. 4 is a side view of the bracket of FIG. 3.

FIGS. 3 and 4 show a paper towel roll dispenser support bracket 30 in accordance with the present invention. Bracket 30 comprises integral vertical and horizontal arms 31, 32 of pressed steel material. Arm 31 is arranged to be screwed to a wall, and is provided with screw holes 14 for that purpose. At its top, arm 31 has a tab 15 for engagement with a cover as described in connection with FIG. 1.

Both edges of both arms 31, 32 are curved to form flanges 35, 36. The curves 37 formed between the major portion of arm 32 and its flanges 36 are arranged to have a predetermined radius of curvature r. Flanges 36, as seen in FIG. 3, actually extend at approximately 5° to the vertical.

Arm 32 is provided with two axially-spaced screw holes 33. At its front end, arm 32 is bent over to form a tab portion 40 with a central aperture 17.

In use a paper towel roll shown in dotted lines at 48, is positioned on arm 32, and the generally cylindrical dispenser cover, parts of which are shown at 50 and 51 in FIG. 4, is presented to the support bracket as described in connection with FIG. 1. Thus the periphery 50 of the cover is engaged by tab 15 and the centre of the closed end 51 of the cover is secured to aperture 17 of tab 40. The free end of the paper towel roll emerges from the dispenser via a slot in the side of the cover extending parallel to arm 32. As is known, the edges of the slot may be serrated to assist in tearing the paper along a desired line.

As paper towel is withdrawn from the slot, the paper roll is rotated around arm 32. During this rotation the curved corners 37 provide a predetermined amount of frictional resistance which is sufficiently low that the roll can be easily rotated without excess tension arising in the paper material (which could cause undesired tearing) but sufficiently high to prevent continued rotation of the roll after the user has stopped pulling on the towel. Such continued rotation leads to wastage of towel and, under certain circumstances, can lead to the entire towel unwinding itself from the roll. The curvature r of the curved corners and their separation d are selected relative to the internal diameter of the paper roll to provide the required braking characteristics. Preferred values of r are up to 5 mm (0.2 inches), of d are 40 mm to 50 mm (1.57 to 1.97 inch) preferably 44 mm (1.73 inch), and of the internal diameter of the paper roll are 50.8 mm to 63.5 mm (2 to 2½ inches).

An advantage of the arrangement described in connection with FIGS. 3 an 4 is that the support bracket is made from a single piece of pressed steel, thus greatly simplifying its assembly, and yet fulfils all the desired functions of the more complicated prior art supports i.e. securing to the wall, mounting of the paper roll, and attachment of the cover both at the rear of its side and the centre of its front. Because it is a one-piece article arranged to be secured to the wall, there is no risk of any part of it dropping off during loading of a fresh paper roll. In addition, the bracket is light, cheap and strong.

The width of arm 32, which corresponds to the separation d of the two curved corners 37, may have any desired value depending on the interior diameter of the paper roll with which it is to be used. Alternatively, a rectangular plate 45, shown in broken lines in FIGS. 3 and 4, may be provided which is arranged to be secured to the upper surface of arm 32 by means of screw holes 33. The plate has a width greater than that of arm 32 and its sides parallel to corners 37 are curved over in a similar fashion thereto. This alternative permits rationalisation of manufacture since a single bracket construction can be used for a number of different paper roll diameters, with only the auxiliary plate being changed. To cater for a paper roll having an internal diameter of 76.2 mm (3 inches), the plate may have a width of 55 mm to 70 mm (2.16 to 2.76 inch) preferably 62 mm (2.44 inches).

Various modifications can be made to the above described arrangement. For example only arm 32, or even only part thereof, may be provided with curved edges 37. The bracket may be made of any suitable material, e.g. a plastics material. The auxiliary rectangular plate may be secured to the upper surface of arm 32 by any convenient method, e.g. welding. Although described in connection with a paper towel dispenser, the bracket may be used for supporting any type of roll, e.g. a toilet roll.

It will be understood that the above description of the present invention is susceptible to various modifications, changes and adaptations.

What is claimed is:

1. A roll dispenser unit comprising a support bracket and a roll to be dispensed mounted on said bracket, said bracket having first and second arms of substantially flat material and arranged substantially at right angles to each other and having longitudinal edges, said edges of said first arm being curved over at least part of their length, wherein the curvature, size and separation of said curved edges are chosen such that in use the frictional forces between the inside surface of said roll and said curved edges are greater than the inertial forces of the rotation of said roll, sid curved edges defining flanges of an angle of substantially 85° with the rest of said first arm, having a radius of curvature of up to 5 mm and being separated by 40 mm to 70 mm; and said arms each having a free end, said free ends being provided with integral attachment means, the unit further comprising a generally cylindrical cover disposed on said bracket, with portions of said cover being engaged by said integral attachment means.

2. A roll dispenser unit comprising a support bracket and a roll to be dispensed mounted on said bracket, said bracket having first and second arms of substantially flat material and arranged substantially at right angles to each other and having longitudinal edges, a parallel plate member secured to said first arm, wherein the parallel plate member is readily and repeatedly attachable to and detachable from said first arm, said plate member having longitudinal edges substantially parallel to the longitudinal edges of said first arm, and said longitudinal edges of said plate member being curved over at least part of their length, wherein the curvature, size and separation of said curved edges are chosen such that in use the frictional forces between the inside surface of said roll and said curved edges are greater than the inertial forces of the rotation of said roll, and said arms each having a free end, said free ends being provided with integral attachment means, the unit further comprising a generally cylindrical cover disposed on said bracket, with portions of said cover being engaged by said integral attachment means.

3. A roll dispenser unit comprising a support bracket and a roll to be dispensed mounted on said bracket, said bracket having first and second arms of substantially flat material and arranged substantially at right angles to each other and having longitudinal edges, a parallel plate member secured to said first arm, wherein the parallel plate mamber is readily and repeatedly attachable to and detachable from said first arm, and said longitudinal edges of said plate member being curved over a least part of their length, wherein the curvature, size and separation of said curved edges are chosen such that in use the frictional forces between the inside surface of said roll and said curved edges is greater than the inertial forces of the rotation of said roll, said curved edges defining flanges of an angle of substantially 85° with the rest of said plate member, having a radius of curvature of up to 5 mm and being separated by 55 mm to 70 mm; said arms of said bracket each having a free end, said free ends being provided with integral attachment means, the unit cover disposed on said bracket, with portions of said cover being engaged by said integral attachment means.

* * * * *

UNITED STATES PATENT AND TRADEMARK OFFICE

CERTIFICATE OF CORRECTION

PATENT NO. : 4,871,122

DATED : OCTOBER 3, 1989

INVENTOR(S) : R. M. G. FIELDING

It is certified that error appears in the above-identified patent and that said Letters Patent is hereby corrected as shown below:

Column 4, line 11, in Claim 1: replace "sid" with --said--

Signed and Sealed this

Twenty-first Day of August, 1990

*Attest:*

HARRY F. MANBECK, JR.

*Attesting Officer*

*Commissioner of Patents and Trademarks*